United States Patent [19]

McFarland

[11] 4,446,849

[45] May 8, 1984

[54] VENT APPARATUS FOR A SURFACE COOKING APPLIANCE

[75] Inventor: Robert H. McFarland, Mansfield, Ohio

[73] Assignee: The Tappan Company, Mansfield, Ohio

[21] Appl. No.: 295,598

[22] Filed: Aug. 24, 1981

[51] Int. Cl.[3] ..... F24C 15/20

[52] U.S. Cl. ..... 126/299 R; 126/300; 126/303; 55/DIG. 36

[58] Field of Search ..... 126/299 R, 299 C, 299 D, 126/303, 300, 21 R, 21 A; 55/DIG. 36; 34/82; 98/115 LH

[56] References Cited

U.S. PATENT DOCUMENTS

| | | | |
|---|---|---|---|
| 2,674,991 | 4/1954 | Schaefer | 126/299 R |
| 3,031,946 | 5/1962 | Watt et al. | 126/299 R |
| 3,409,005 | 11/1968 | Field | 126/299 R |
| 3,425,334 | 2/1969 | Brown et al. | 126/299 D |
| 3,889,392 | 9/1975 | Davis et al. | 34/82 |
| 3,912,473 | 10/1975 | Wilkins | 126/299 D |
| 4,034,663 | 7/1977 | Jenn et al. | 126/299 D |

*Primary Examiner*—James C. Yeung

*Attorney, Agent, or Firm*—Alfred E. Miller

[57] ABSTRACT

A vent apparatus for a surface cooking appliance comprises a vertically slidable closure mounted to slide in a duct in the surface of the appliance. The closure has a slide engaging a track in the front of the duct below the surface of the appliance, an open side within which filters may be removably mounted.

12 Claims, 8 Drawing Figures

34
30
38
31
37
23
24
20
21
24
36
32
33

37
34

90
85
59
59
56
57
4
4
57
58
55
101
55
58
75
155
42
41
71
71
31
47
49
71
71
70
50
48
33

37
91
90
30
34
61
41
22
59
62
63
41
21
66
67
92
60
43
65
43
55
40
42
31
45
70
46
51
49
48
33
32

8
95
61
92
34
30
37
91
90
36
80
100
152
150
151
82
102
101
153
45
70
76
75
85
84
101
80
76
85
36
37
101
152
151
150
45
90
102
100
92
36

VENT APPARATUS FOR A SURFACE COOKING APPLIANCE

This invention relates to an arrangement for venting smoke, gases and the like from a surface cooking appliance, and is more particularly directed to such an apparatus wherein the vent may be retracted when not in use.

Those retractable ventilating systems for use in conjunction with cooking means are disclosed in U.S. Pat. No. 2,674,991, Schaefer, U.S. Pat. No. 3,011,492, Humbert, U.S. Pat. No. 3,102,533, Jenn et al and U.S. Pat. No. 3,409,005, Field. In the interlating systems of the Schaefer and Field references, retractable assemblies are employed having apertures exposable when the assembly is lifted.

While smoke and cooking gases may be drawn into such apertures by means of a suitable blower, the present invention is directed to the provision of an assembly that is adjustable in a similar manner, but which optimizes the flow of the smoke and gases, by enabling the provision of filtered flow paths of much greater cross section.

The invention is further directed to a ventilating system wherein the retractable unit is operable without reaching over the range units, as in the arrangement of the Humbert patent, and which does not require covering of the range units when not in use, as in the Jenn et al patent.

The invention is further directed to the conveniently operable ventilating apparatus, having further advantageous features, as will be discussed in the following disclosure.

Briefly stated, in accordance with the invention, a vertically extending duct is provided in the surface of a surface cooking appliance, adjacent the cooking units, the duct extending downwardly from the unit. A track is provided in the duct, preferably at the front of the duct, for receiving a slide assembly. The slide assembly, vertically movable in the track, has a front wall adapted to engage the track, and a cover. The cover may have sealing lip so that when the slide assembly is in its lowermost position, the lip is sealed to the surface of the unit, thereby sealing the duct. The slide assembly may have a rear wall sealable with respect to the rear of the duct. The sides of the slide assembly, however, are fully open, with provision being made for releasably holding filters in the open sides thereof. As a consequence, a flow path of very large cross section is provided between the slide assembly and the duct, thereby enabling the simpler exhaust of smoke, cooking gases and the like, without requiring an exhaust pump of excessive capacity.

In a further feature of the invention, the assembly is provided with a switch operable upon the movement of the slide assembly to its uppermost position, thereby to enable turning on of a blower in the duct at such times that air flow through the duct is required.

In a still further feature of the invention, the slide assembly is readily removable from the duct, thereby to simplify cleaning of the assembly, and of the separable filters.

In order that the invention will be more clearly understood, it will now be disclosed in greater detail with reference to the accompanying drawings, wherein.

Figure 1:
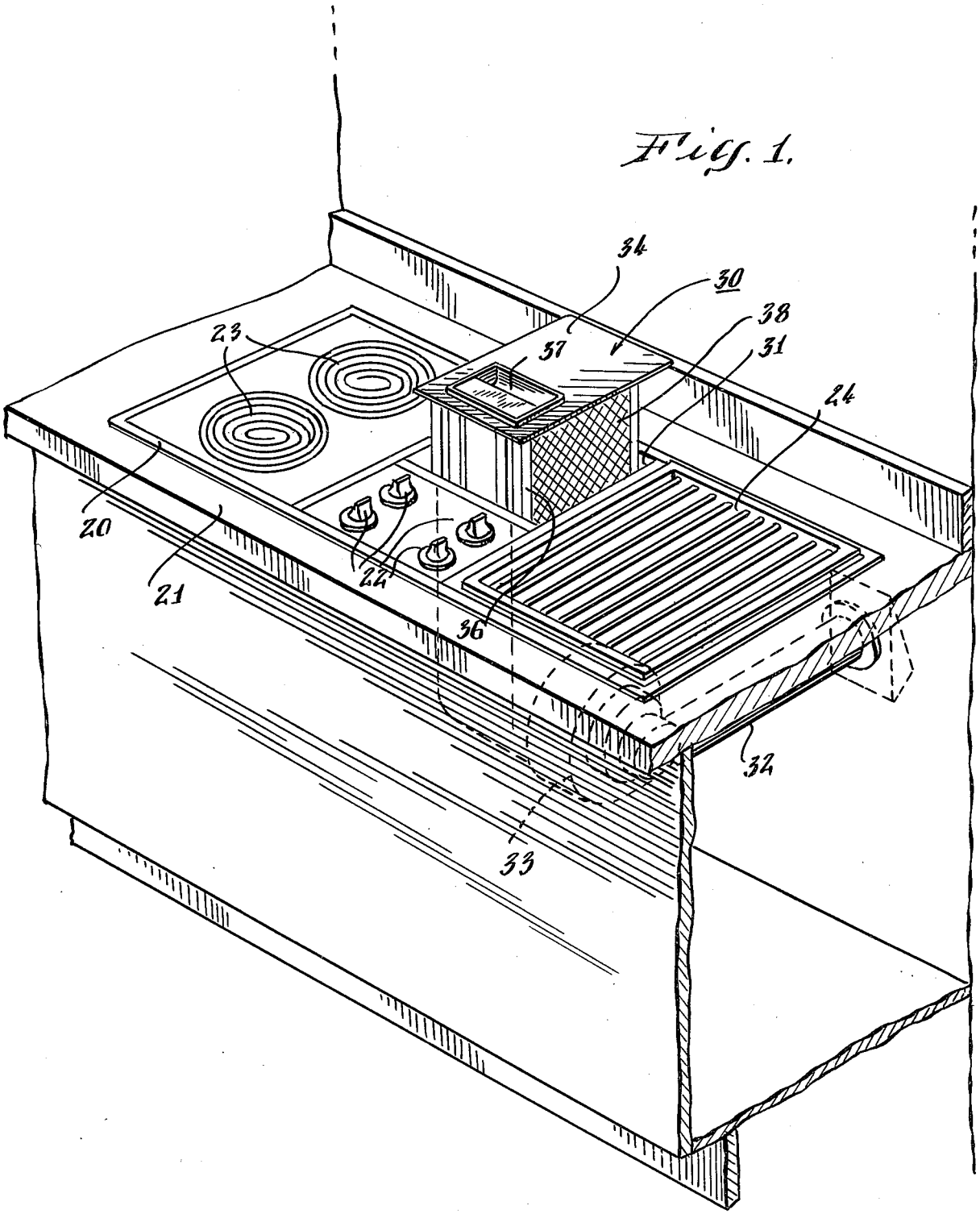
FIG. 1 is a perspective view of a surface cooking unit employing the ventilating assembly of the invention.

Referring now to FIG. 1, therein is illustrated one form of a surface cooking appliance 20 mounted, for example, in a counter top 21. In this form of the appliance, a plurality of control knobs (22) may be provided in the front center region of the generally rectangular appliance, with a pair of electric surface heating elements 23 positioned one in front of the other at the left side of the appliance. A grill 24 is depicted at the right side of the appliance. It is of course immaterial, from the standpoint of the present invention, whether the surface cooking elements are electrically or gas heated. In the use of such surface units, it is well known that smoke, vapors and the like may rise from food being heated on the surface unit, and the provision of venting means for withdrawing such contaminants from the air is well known. In a typical system, a hood may be provided above the cooking appliance. On some occasions, however, the installation of such a hood may be expensive or not feasible.

Therefore, in accordance with the invention, a venting apparatus is provided on the appliance itself. As illustrated in FIG. 1, the venting apparatus comprises a vertically slidable assembly 30 movable in a duct 31 extending vertically between the surface units 23 and 24. The duct 31 thus extends below the counter 21, and may be exhausted through suitable exhaust pipes 32 by means of a ventilation fan 33. The vertically sliding assembly 30 has a horizontal duct cover 34 preferably of a size somewhat larger than the upper opening of the duct 31. The cover 34 is held on a vertically extending side 36 which is guided, preferably within the duct 31, by means of a suitable track (not shown in FIG. 1).

The slide 36 and cover 34 hold a pair of vertically oriented filters 38, one on each side of the slide assembly, and positioned so that air to be exhausted from the region of the surface units is drawn horizontally through the adjacent filter 38, thence downwardly through the duct 31 and eventually is exhausted by way of the exhaust duct 32.

The slide assembly has a handle 37 or other lifting means, preferably in the top of the cover 34, so that one using the appliance may lift the slide assembly to the position shown in FIG. 1. The slide assembly may also be retracted, by depressing the cover 34 downwardly, until the entire slide assembly is moved to a limit position within the duct and the cover 34 covers the top of the duct 31.

Figure 2:
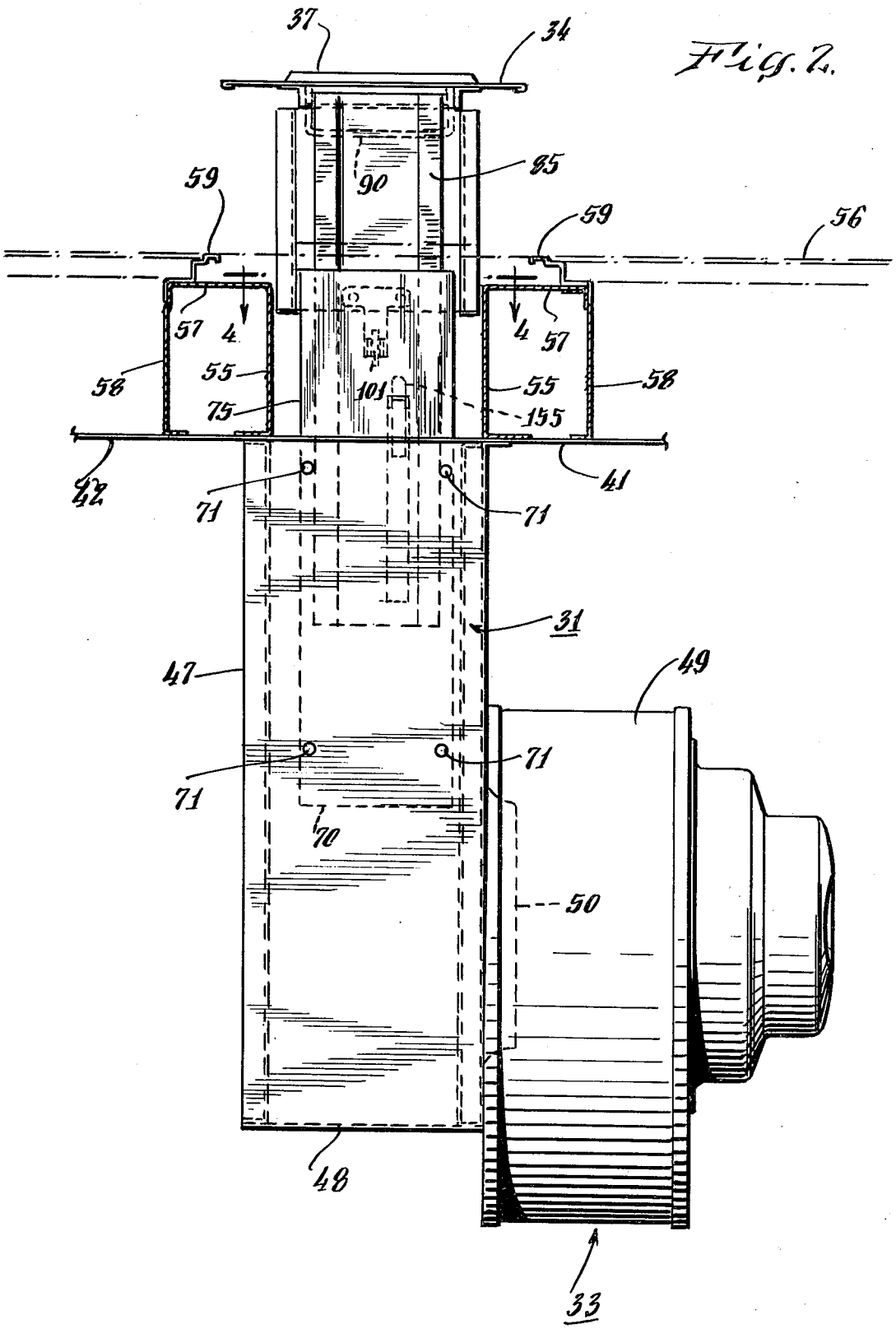
FIG. 2 is an enlarged partially cross sectional view of the assembly of FIG. 1, taken in a vertical plane parallel to the front of the assembly.
Figure 3:
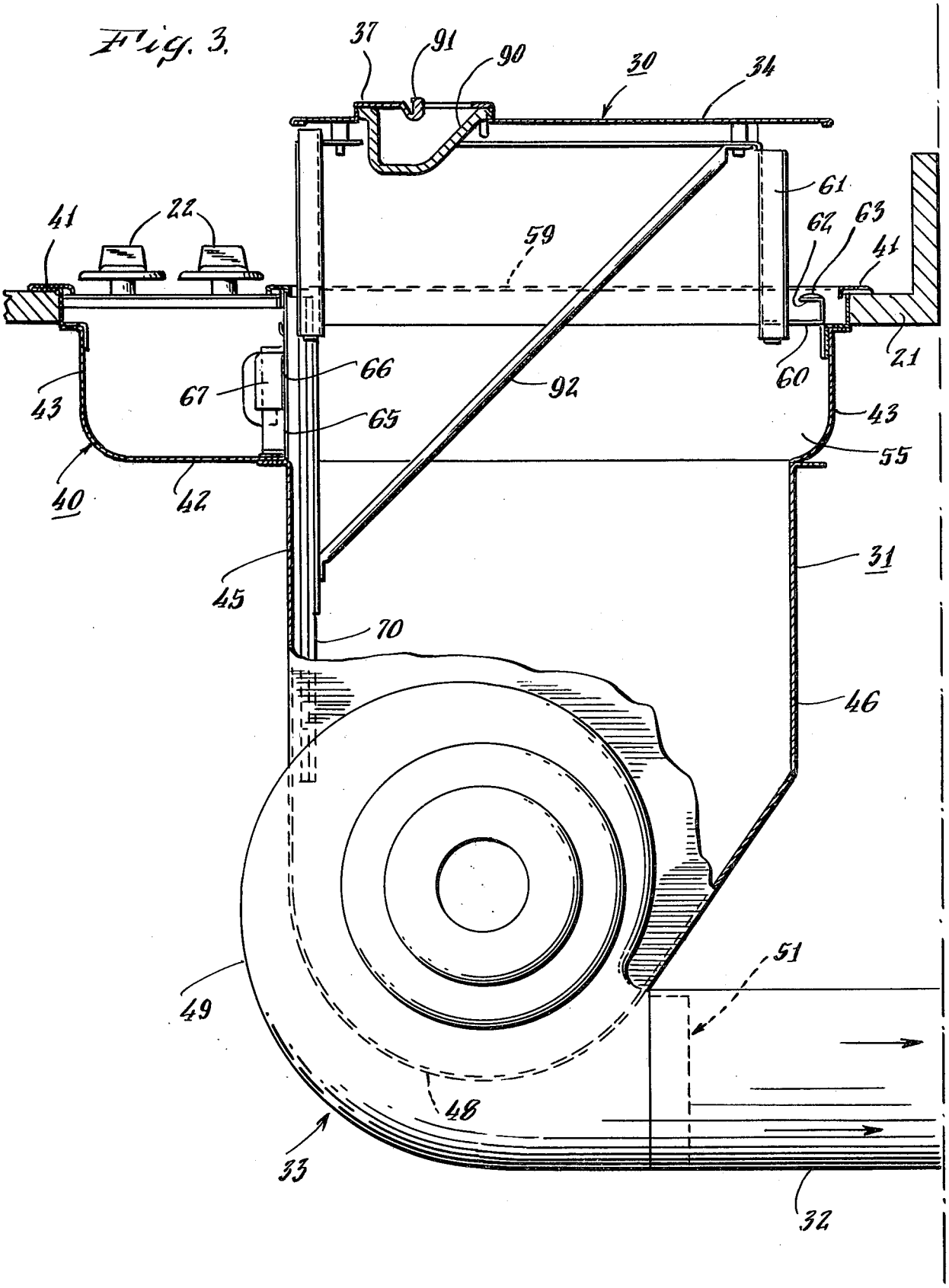
FIG. 3 is an enlarged partially cross sectional view of the assembly of the invention, taken in a vertical plane normal to the view of FIG. 2.

Referring now to FIGS. 2 and 3, the frame 40 of the appliance has an upper peripheral lip 41 for resting and being affixed to the counter 21, the center portions of the frame being downwardly recessed and having a bottom 42 and side walls 43. A generally rectangular aperture is provided in the center rear of the bottom of the frame, and a rectangular duct having front walls 45, rear wall 46 and side walls 47 is provided extending downwardly from the aperture in the bottom of the frame. This downwardly extending duct portion has a bottom 48. A blower housing 49 is sealed to the bottom side of the duct assembly, surrounding a vent hole 50 in the duct, the blower housing containing a suitable electric blower (not shown), and having an outlet 51 for connection to exhaust pipe 32 shown in FIGS. 1 and 3. As shown in FIG. 2, upper side walls 55 define the sides of the upper portion of the duct, these walls extending upwardly from the aperture in the bottom 42, to slightly below the top level 56 of the appliance. The walls 55 are thence bent to extend horizontally away from the duct, as shown at 57, and further vertical walls 58 are provided spaced from the vertical portions of the walls 45 and joining the ends of the horizontal portions 57 to separate the burner recesses from the duct portion of the appliance. Lips 59 are affixed to the top of the horizontal portions 47, the lips 59 extending from front to back of the unit, spaced slightly from the duct, the lips cooperating with the duct cover 34 to close the duct, as will be explained in greater detail in the following paragraphs.

As shown more clearly in FIG. 3, the side walls 55 extend completely to the back wall of the frame recess. No vertical extension of the rear wall of the duct is provided in this region, since the duct is too close to the back of the frame to permit the simple provision of such a wall. In order to seal this region of the duct, however, an angle element 60 extends between the side walls 55 to cover the duct at the rear of the frame, and to seal the rear wall 61 of the slide assembly 30. The angle element 60 has an upper edge 62, which may have a rubber stop element 63, for the purpose of sealing the rear of the duct when the duct cover is in its lowermost position, and the rubber stop serving to avoid metal to metal contact. Is also rear guide for assembly.

Still referring to FIG. 3, a wall 65 is provided extending upwardly from the aperture in the bottom of the frame, to serve as the upper front wall of the duct. An aperture 66 exposes a switch 67 to the duct. The switch 67 is hence in the front portion of the recess of the frame. This switch, as will be explained in greater detail in the following paragraphs, serves to control the operation of the blower motor.

A vertically extending track 70 is affixed to the inner front walls 45 and 65 of the duct, for example by means of screw 71. The track 70, which is more clearly seen in the cross section of FIG. 4 has a front plate portion 75 to fit against the walls of the duct, and a pair of angle-shaped side guides 76 to serve as the restraining track for the slide.

Figures 4, 5, 6:
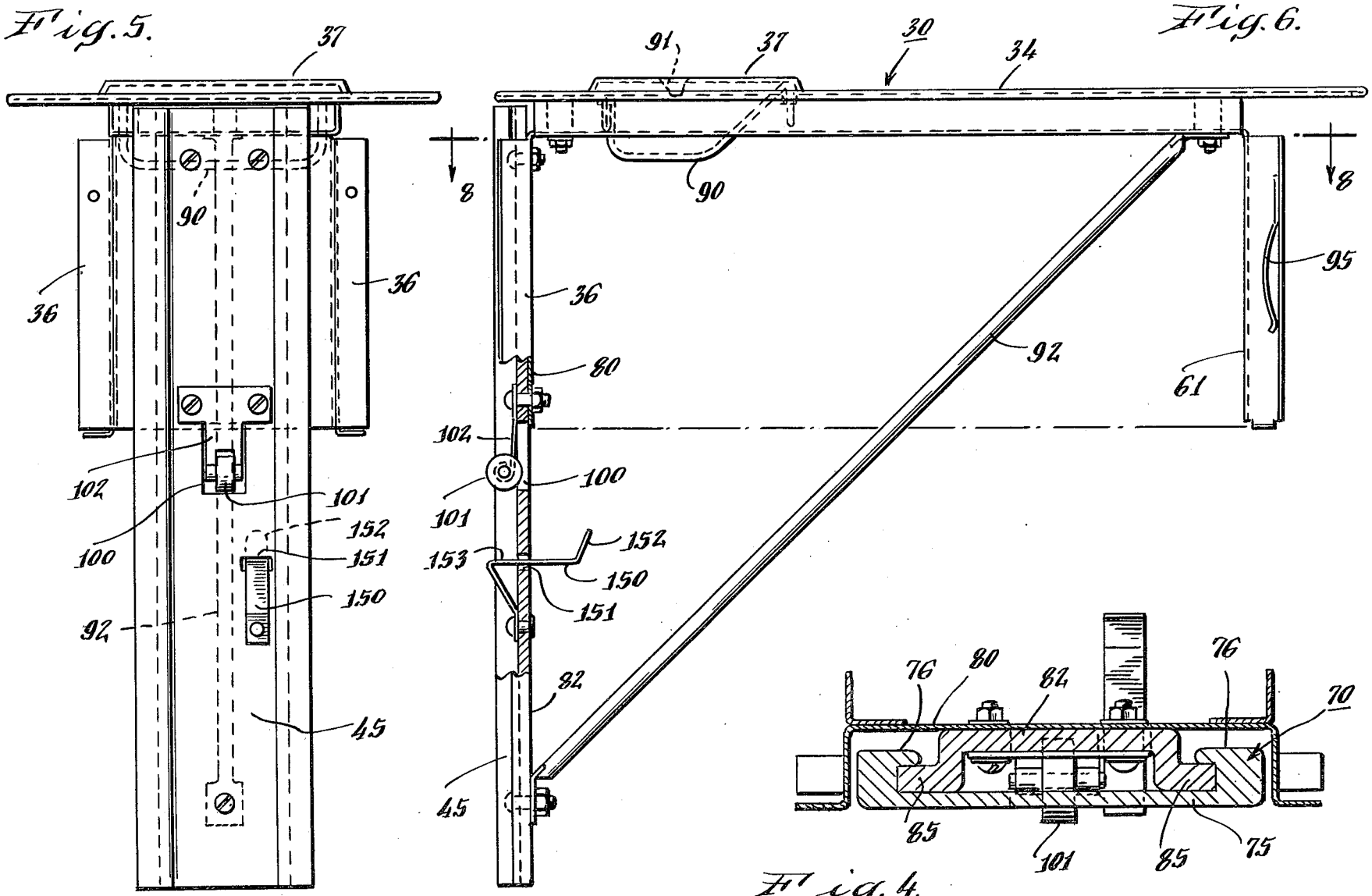
FIG. 4 is a cross sectional view of the track and slide elements, taken along the lines 4—4 of FIG. 2.
FIG. 5 is a front view of the slide assembly.
FIG. 6 is a partially cross sectional side view of the slide assembly.
Figure 7:
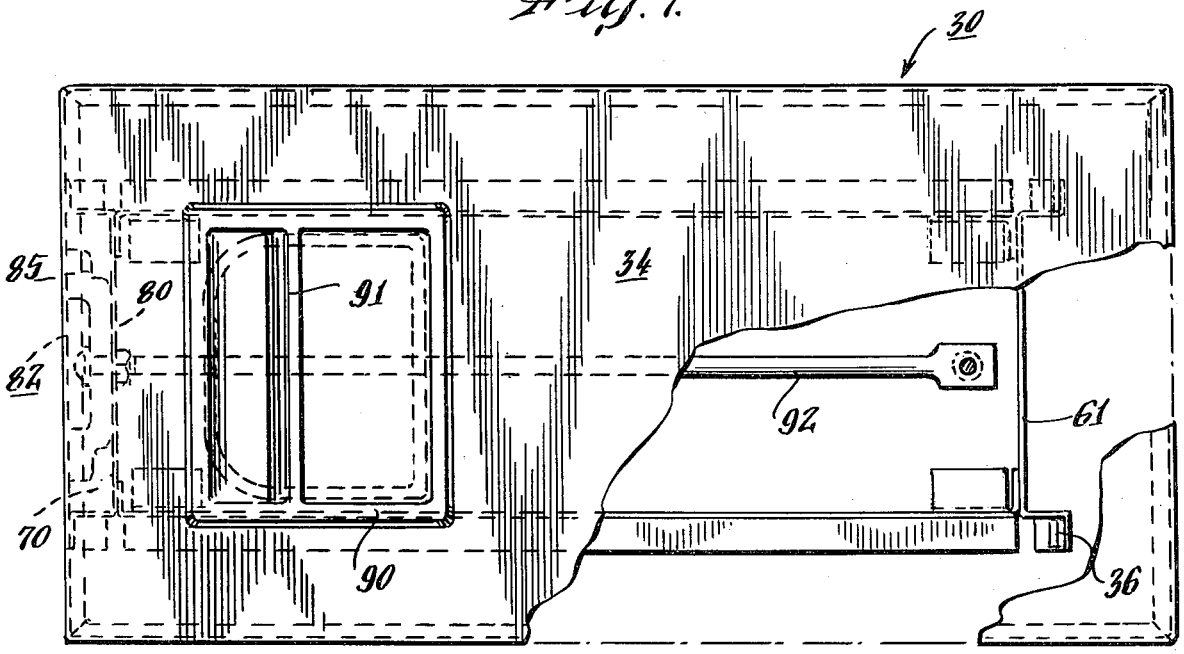
FIG. 7 is a partially broken away top view of the slide assembly.
Figure 8:
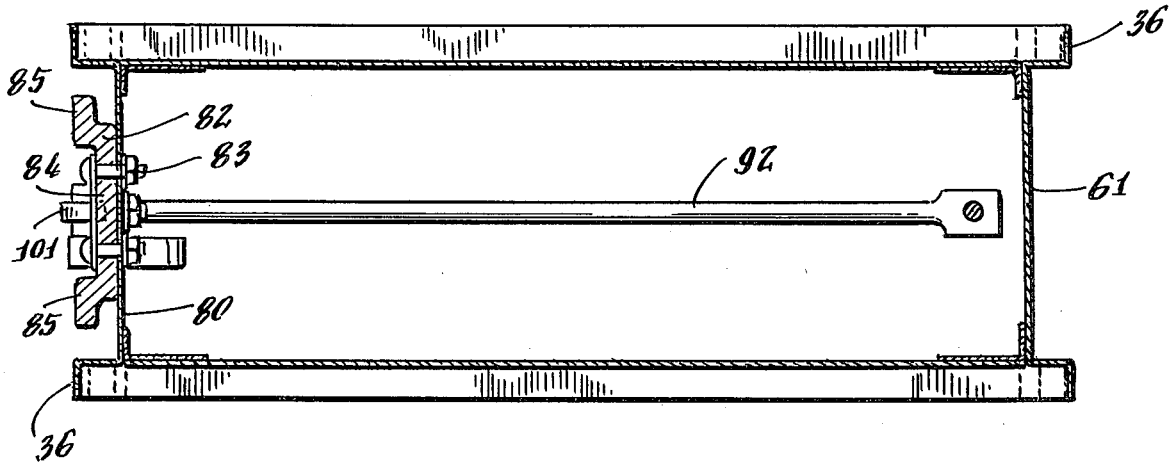
FIG. 8 is a cross sectional view of the slide assembly, taken along the lines 8—8 of FIG. 6.

The slide assembly is more clearly illustrated in FIGS. 5, 6, 7 and 8, and is comprised of a front wall 80 having its side edges bent forwardly and thence outwardly, as more clearly shown in FIGS. 4 and 8. A vertically extending slide 82 is affixed to the wall 80, for example by means of bolts 83. The slide plate 82 has a central flat portion 84 engaging the wall 80, and forwardly and thence outwardly extending slide edges 85. The slide edges 85 are dimensioned to be guided in the guide channels defined by the angle-shaped ends 76 of the guide rail, as more clearly shown in FIG. 4.

The cover is affixed to the top of the front wall 80, to extend rearwardly therefrom, as shown in FIG. 6. This top cover is preferably rectangular, having outer dimensions slightly greater than those of the sealing lips that it engages when in the lowermost position. A handle in the top wall may be formed by a recessed member 90 affixed in an aperture in the top of the cover 34, and having a lip 91 to serve as the handle element.

As shown in FIG. 6, the front wall 80 does not extend downwardly the full length of the guide plate. The wall is unnecessary in the lower portions of the slide assembly, since these portions are within the duct 31. Similarly, the rear wall 61 of the slide assembly also extends only from the cover 34 to just within the duct 31, when the slide assembly is in its uppermost position. In order to strengthen the slide assembly, due to its simplified construction, a diagonal brace 92 may be provided extending from adjacent the bottom of the guide plate 82 too, to adjacent the rear of the cover 34, as clearly shown in FIGS. 3 and 6.

The slide assembly, as thus far described, has a front wall, top wall and rear wall, and is open at its sides. The sides of the slide assembly are shaped to removably receive filters, such as screen filters 38 as shown in FIG. 1. For this purpose, the edges of the cover 34, front wall 80 and rear wall 61 are formed with peripheral rectilinear recesses of a shape to permit the fitting of a filter screen therein. In order to hold the screen in place, suitable leaf springs 95 may be provided, for example in the recesses of the rear wall 61. With this arrangement the filter screens may be readily removed for cleaning, and replaced.

Referring again to FIG. 6, a rectangular aperture 100 is provided in the slide plate 82 at a level within the duct when the slide is in its uppermost position. A detent roller 101 is held in front of the aperture 100, by means of a spring plate 102, whereby the detent roller may be urged into the aperture 100.

The track 70 has an aperture (not shown) aligned with the switch 67, and the detent roller 101 is positioned so that, at the uppermost position of the slide assembly, the detent roller will engage such aperture and operate the switch. Consequently, when the slide assembly is moved to its uppermost position, the detent roller not only holds the slide assembly in this position due to its cooperation with the aperture in the track, but also operates the switch 67 to turn on the blower motor. The detent roller 101 may be removed from this aperture, and from contacting relationship with the switch, by downward exertion on the cover of the slide assembly. If desired, a further aperture (not shown) may be provided in the track 70, to receive the detent roller at the lowermost position of the slide assembly, when its lip engages the top surface of the unit.

Referring to FIGS. 5 and 6, a spring latch 150 has one end affixed to the front of the front wall 45, the spring extending upwardly at an angle to the wall 45, and thence horizontally rearwardly through an aperture 151. The rear end 152 of the spring latch is hence within the duct, and is formed so that it may be operated by a finger or the like. The horizontal surface 153 of the spring latch 150 extends into a vertically extending slot 155 in the track, as shown in FIG. 2. The horizontal surface of the spring latch is positioned to engage the upper edge of the slot 155 at the position of the slide assembly when the detent roller engages the switch. As a result, the slide assembly is normally prevented from being lifted upwardly from its upward operating position with the blower on.

If desired, however, for the purpose of cleaning, the slide assembly may be removed by first removing the filters, then reaching into the assembly and depressing the end 152 of the spring latch. This releases the spring latch from the slot 155, so that the assembly may be removed upwardly. For reinsertion of the slide assembly in the track, no manipulation of the spring latch is required, since the lower edge thereof is slanted with respect to the track and front wall of the slide assembly.

In operation, when the slide assembly is not in use, it is lowered to the position with the lip thereof engaging the surface of the unit, thereby to seal the duct. At this time, the blower motor is not actuated. When the arrangement is to be employed, the user merely lifts up the unit by means of the handle in the cover, until the detent roller has engaged the switch to start the blower motor, and the spring latch has prevented further upward movement of the slide assembly. At this time, with the blower motor on, smoke and gases from the range will be drawn through the filters, and thence exhausted outwardly. As discussed above, the slide assembly may be readily removed, so that it, and the filters themselves may be easily cleaned.

In order to stop operation of the assembly, it is merely necessary to push down on the cover, until the lip thereof engages the surface of the unit to seal the duct.

While the invention has been disclosed and described with reference to a single embodiment, it is apparent that variations and modifications may be made therein. For Example, the slide assembly can be motor driven. It is therefore intended in the following claims to cover each such variation and modification as falls within the true spirit and scope of the invention.

What is claimed is:

1. In a ventilating system for a surface cooking appliance having a ventilating duct extending downwardly through a generally horizontal surface adjacent at least one cooking unit, and a ventilator mounted for vertical movement with respect to said duct and having a lowermost position and an uppermost position, the improvement wherein said ventilator has a substantially rectangular horizontal top having a front edge, a pair of opposite side edges, and a rear edge, said top being shaped to cover and substantially seal the upper end of said duct in said lowermost position of said ventilator, vertical support means extending downwardly from said adjacent the front edge of said top for selectively holding said ventilator at said lowermost position and said uppermost position wherein said top is substantially above said surface, said ventilator having a substantially open side extending downwardly from one of said side edges and being substantially completely open between said top and said surface when said ventilator is in said uppermost position, and a flat vertically oriented filter mounted to substantially completely and removably cover said open side of said ventilator and to move vertically with said ventilator, said vertical support means comprising substantially the sole support for said top.

2. The ventilating system of claim 1 wherein said duct is rectangular in cross section, with the longer side being adjacent said cooking unit.

3. The ventilator system of claim 2 wherein said duct is rectangular in cross section with one long side thereof being adjacent said one cooking unit and the other long side thereof being adjacent another cooking unit, the sides of said ventilator toward both of said long sides of said duct being substantially fully open and further comprising a second flat vertically oriented filter removably mounted to cover the open side of said ventilator opposite said first mentioned open side.

4. In a ventilating system for a surface cooking appliance having a ventilating duct extending downwardly through a substantially horizontal surface adjacent a cooking element, and a ventilator mounted for vertical displacement with respect to said duct; the improvement wherein said duct has a substantially rectangular cross section, said ventilator has a vertical plate means vertically slidably mounted in said duct to a wall thereof and defining the front of said ventilator, a top depending from and being substantially solely supported by said plate means, said top being shaped to cover the upper end of said duct means in a lowermost position of said ventilator, the sides of said ventilator adjacent said front being substantially completely open between said surface and top in the uppermost position of said ventilator, recesses being provided on both sides of said ventilator adjacent the open sides thereof, and separate planar vertical filters removably mounted in said recesses to cover each of the open sides thereof.

5. The ventilating system of claim 4 wherein said plate means has a vertically extending guide mounted thereon slidably engaging a vertically extending track on the front inner wall of said duct.

6. The ventilating system of claim 5 wherein said guide and track serve the only support for the vertical movement of said ventilator.

7. The ventilating system of claim 6 wherein said ventilator is vertically removable from said track.

8. The ventilating system of claim 5 wherein the front wall of said duct has a plurality of vertically spaced apertures thereon, and the plate means has a spring mounted roller thereon positioned to engage separate ones of said apertures to serve as holding means at a plurality of different positions.

9. The ventilating system of claim 4 further comprising switch means fixedly mounted in said appliance, and means on said plate means for engaging said switch means at determined positions above said lowermost position, and further comprising blower means in said duct responsive to actuation of said switch means, whereby said blower means is turned on upon the raising of said ventilator a determined amount.

10. The ventilating system of claim 4 wherein said top of said ventilator is substantially flat and has a pull up handle in its upper surface.

11. In a ventilating system for a surface cooking appliance having a substantially rectangular ventilating duct extending downwardly through a substantially horizontal surface adjacent at least one cooking element, and a ventilator having a substantially rectangular cross section and mounted for vertical displacement with respect to said duct; the improvement wherein said ventilator comprises a vertical plate means defining the front of said ventilator, a vertically extending track on the front inner wall of said duct, said plate means having a vertically extending guide mounted thereon and slidably engaging said vertically extending track, said guide and track serving as the sole support for said ventilator, said ventilator further having a substantially horizontal top depending from said plate means and shaped to cover the upper end of said duct means in the lowermost position of said ventilator, and a rear covering the back side of said ventilator, at least one side of said ventilator being substantially completely open between said top and surface in the uppermost position of said ventilator and being removably covered by at least one planar vertically oriented filter.

12. The ventilating system of claim 11 further comprising means for resiliently holding said ventilator at said uppermost and lowermost positions, said ventilator being vertically removable from said duct.

* * * * *